US007846045B1

(12) United States Patent
Kendall

(10) Patent No.: US 7,846,045 B1
(45) Date of Patent: Dec. 7, 2010

(54) PNEUMATIC PRACTICE TEE

(75) Inventor: Todd Kendall, White Bear Lake, MN (US)

(73) Assignee: Hitzone Sports, LLC, North Oaks, MN (US)

( * ) Notice: Subject to any disclaimer, the term of this patent is extended or adjusted under 35 U.S.C. 154(b) by 159 days.

(21) Appl. No.: 11/936,175

(22) Filed: Nov. 7, 2007

(51) Int. Cl.
*A63B 71/00* (2006.01)

(52) U.S. Cl. ..... 473/418; 473/417; 473/422

(58) Field of Classification Search ..... 473/418, 473/417, 431, 451; 124/56; 40/610
See application file for complete search history.

(56) References Cited

U.S. PATENT DOCUMENTS

| | | | | |
|---|---|---|---|---|
| 1,744,680 | A | 1/1930 | Sherrill | |
| 2,091,883 | A | 8/1937 | Rochwarg | |
| 4,045,906 | A | 9/1977 | Goldfarb et al. | |
| 4,136,869 | A * | 1/1979 | Tassone | 473/417 |
| 4,564,195 | A | 1/1986 | McClure et al. | |
| 4,575,080 | A | 3/1986 | Miles | |
| 4,858,921 | A | 8/1989 | Eustice et al. | |
| 4,946,164 | A | 8/1990 | Fuller et al. | |
| 5,011,144 | A | 4/1991 | Marello et al. | |
| 5,145,176 | A | 9/1992 | Lipson | |
| 6,454,670 | B1 * | 9/2002 | Beers | 473/451 |
| 6,652,394 | B1 * | 11/2003 | Tener | 473/417 |
| 6,804,905 | B1 * | 10/2004 | Burger et al. | 40/610 |
| 6,823,801 | B2 * | 11/2004 | Lieberman | 108/25 |
| 7,294,071 | B1 * | 11/2007 | Saumell | 473/451 |
| 2002/0198068 | A1 | 12/2002 | Jordan | |
| 2007/0238554 | A1 * | 10/2007 | Hu | 473/417 |
| 2008/0009373 | A1 * | 1/2008 | Binder et al. | 473/418 |
| 2009/0038480 | A1 * | 2/2009 | Garman et al. | 96/414 |

* cited by examiner

*Primary Examiner*—Mitra Aryanpour
(74) *Attorney, Agent, or Firm*—Sherrill Law Offices, PLLC

(57) ABSTRACT

A pneumatic practice tee and method of practicing the striking of a sports ball with a striking instrument using the tee. The tee includes a base, a housing, a fan and an inflatable sleeve. The base supports the practice tee upon a horizontal surface. The housing is supported by the base and has an air inlet and an air outlet. The fan is retained within the housing and for producing an air current, directed by the housing through the outlet. The inflatable sleeve is in fluid communication with the air outlet with the proximal longitudinal end attached to the housing and a nozzle provided in the longitudinal distal end.

4 Claims, 3 Drawing Sheets

PNEUMATIC PRACTICE TEE

FIELD OF INVENTION

The invention relates to tees, and more particularly to pneumatic practice tees capable of generating a jet of air effective for supporting a ball.

BACKGROUND

A number of different types of pneumatic practice tees have been developed which employ an air stream to support a ball in an elevated position above the tee based upon the Bernoulli Effect. Exemplary tees are described in U.S. Pat. No. 4,564,195 (tennis); U.S. Pat. No. 4,575,080 (baseball or softball), U.S. Pat. No. 4,858,921 (baseball or softball), U.S. Pat. No. 5,011,144 (tennis) and U.S. Pat. No. 5,145,176 (golf), and United States Patents Application Publication 2002/0198068 (generic sports ball).

While generally effective as a training device for facilitating hitting practice and providing instantaneous feed-back by permitting the user to observe flight of the struck ball, room remains for improvement.

Accordingly, a need exists for an improved pneumatic practice tee.

SUMMARY OF THE INVENTION

A first aspect of the invention is a pneumatic practice tee. The tee includes a base, a housing, a fan and an inflatable sleeve. The base supports the practice tee upon a horizontal surface. The housing is supported by the base and has an air inlet and an air outlet. The fan is retained within the housing and for producing an air current, directed by the housing through the outlet. The inflatable sleeve is in fluid communication with the air outlet with the proximal longitudinal end attached to the housing and a nozzle provided in the longitudinal distal end.

A second aspect of the invention is a kit for assembly of a pneumatic practice tee. The kit includes a base, housing, fan and plurality of inflatable sleeves. The base supports the practice tee upon a horizontal surface. The housing is supported by the base and has an air inlet and an air outlet. The fan is retained within the housing and for producing an air current, directed by the housing through the outlet. The inflatable sleeves each have (i) a proximal longitudinal end configured and arranged for releasable attachment to the housing over the air outlet for inflation of the sleeve by the fan, and (ii) a nozzle at a longitudinal distal end. The sleeves each have a different longitudinal length.

A third aspect of the invention is a method of practicing the striking of a sports ball with a striking instrument. The method includes the steps of (A) obtaining a pneumatic practice tee in accordance with the first aspect of the invention, (B) placing the pneumatic practice tee upright upon a horizontal support surface, (C) activating the fan to inflate the sleeve and generate an air jet exiting the pneumatic practice tee through the nozzle, (D) placing a sports ball within the air jet, whereby the sports ball is supported a distance above the nozzle by the air jet, and (E) striking the sports ball supported by the air jet with a striking instrument.

DETAILED DESCRIPTION OF THE INVENTION INCLUDING A BEST MODE

Nomenclature

10 Tee
20 Base
30 Housing
31 Collar Surrounding Outlet
38 Inlet
39 Outlet
40 Fan
51 On/Off Switch
60 Power Source
61 Battery
62 Electrical Cord
70 Clamp
80 Sleeve
80*a* Short Sleeve
80*b* Intermediate Length Sleeve
80*c* Long Sleeve
81 Proximal Longitudinal End of Sleeve
82 Distal Longitudinal End of Sleeve
89 Nozzle
89*a* Single Small Nozzle
89*b* Single Large Nozzle
89*c* Several Circumferentially Spaced Nozzles
101 Sports Ball
101*a* Baseball
101*b* Tennis Ball
102 Striking Instrument
102*a* Baseball Bat
102*b* Tennis Racquet
A Air Jet or Air Current
H Horizontal Surface
V Vertical Surface Definitions As utilized herein, including the claims, the term "limp" means lacking a firm structure, such that in the absence of a supporting structure or medium it is unable to retain a given shape against the force of gravity.

Construction

Figure 1:
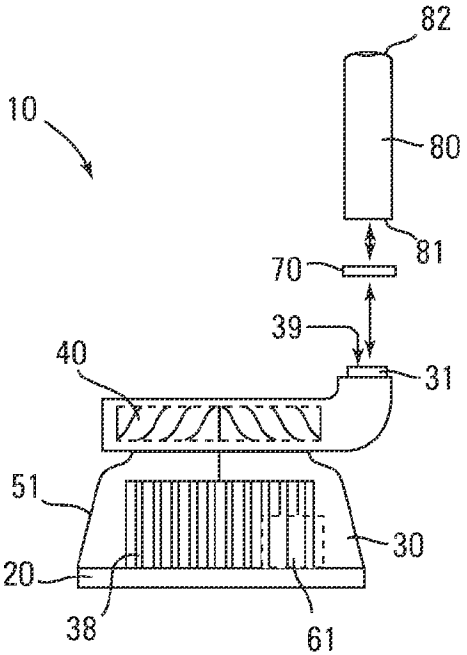
FIG. 1 is an exploded side view of one embodiment of the invention.
Figure 2:
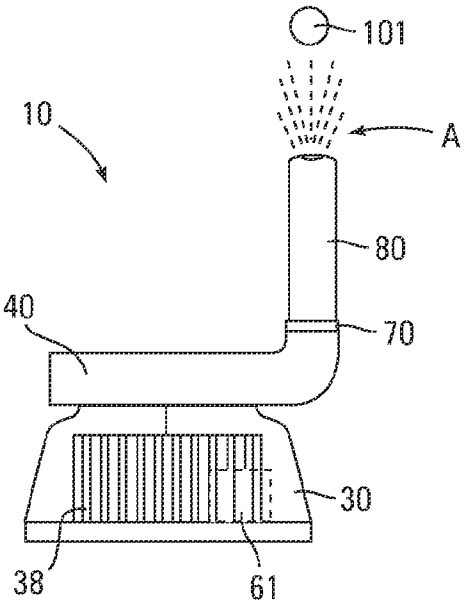
FIG. 2 is a cross-sectional side view of the fully assembled invention shown in FIG. 1 with the sleeve inflated.

As shown in FIGS. 1 and 2, a first aspect of the invention is a pneumatic practice tee 10 for generating an upwardly directed air jet A capable of stably supporting a sports ball 101 above the tee 10 in accordance with the Bernoulli Principle. The tee 10 includes a base 20, a housing 30, a fan 40, a clamp 70 and a sleeve 80. The tee 10 is preferably portable, weighing less than eighteen pounds.

The base 20 supports the practice tee 10 upon a horizontal H surface, such as a concrete slab, an asphalt driveway, a paver block patio, a lawn, the gravel infield of a baseball diamond, the grassy outfield of a baseball diamond, etc.

The housing 30 is supported by the base 20 with an air inlet 38 and an air outlet 39. The air outlet is preferably directly vertically V upward, nearly perpendicular (i.e., about 80° to) 100° to a horizontal H surface supporting the tee 10. A collar 31 surrounds the air outlet 39 for facilitating attachment of the sleeve 80 over the air outlet 39. The housing 30 may be constructed from any suitable material, including specifically but not exclusively, cardboard, card stock, fiberboard, plastic, metal, rubber, etc.

The fan 40 is retained within the housing 30. The fan 40 is positioned within the housing 30 and the housing 30 configured and arranged so that the fan 40 pulls air from the surrounding environment into the housing 30 through the air inlet 38 and forces that air out of the housing 30 through the air outlet 39. The fan 40 must be able to generate an air jet A exiting the tee 10 of sufficient velocity to stably support a sports ball 101 of the desired type above the tee 10.

Figure 3:
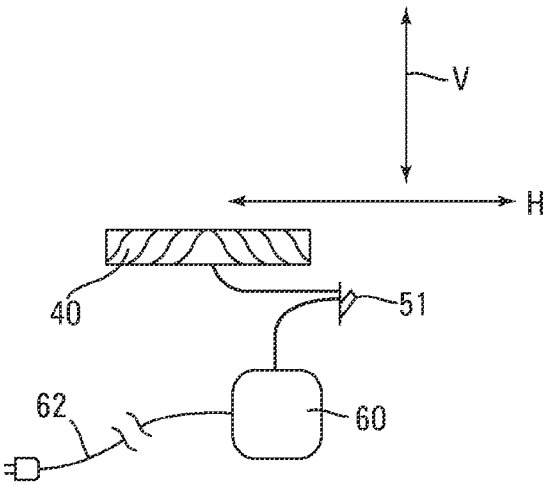
FIG. 3 is an electrical schematic of the invention shown in FIG. 1.
Figure 5A:
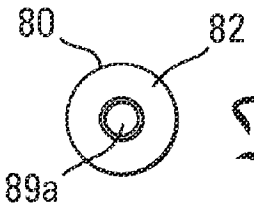
FIGS. 5*a-c* are top views of several exemplary sleeves having different nozzles.
Figure 5B:
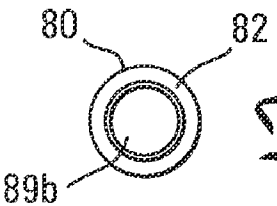
Figure 5C:
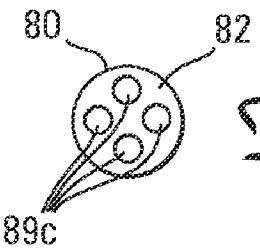
Figure 4C:
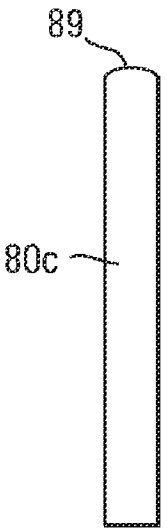
FIGS. 4*a-c* are side views of several exemplary sleeves of different longitudinal length.
Figure 4B:
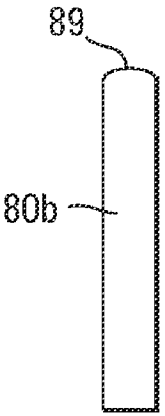
Figure 4A:
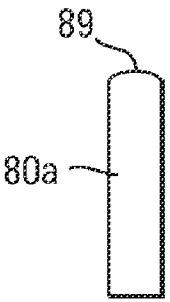

Referring to FIGS. 1, 2 and 3, an ON/OFF switch 51 is provided for controlling the supply of power from a power source 60, such as a battery 61 or an electrical outlet (not shown), to the fan 40.

Referring to FIGS. 1 and 2, the proximal longitudinal end 81 of the inflatable sleeve 80 is secured to the collar 31 by a suitable clamping mechanism 70. Any of the well-known and widely available mechanisms for releasably attaching tubing may be employed, including specifically but not exclusively, clamp collars, spring band clamps, worm-drive band clamps, t-bolt band clamps, v-band clamps, turn-key band clamps, snaplock quick release band clamps, p-clips, etc. such as those available from Ideal Company of St. Augustine, Fla. Other inexpensive fastening options can also be used such as a simple rubber band, a twist-tie, a bungee cord, a cable-tie, etc. Other, more expensive fastening devices and techniques can also be employed, such as friction fittings, threaded couplings, quick disconnect couplings, etc.

The sleeve 80 is an inflatable longitudinal length of material about 2 to 60 inches long, preferably about 6 to 40 inches long and most preferably about 10 to 40 inches long, open at a longitudinal proximal end 81 for attachment to the collar 31 surrounding the air outlet 39. A nozzle 89 is provided in the distal longitudinal end 82 of the sleeve 80. The nozzle 89 has a size, shape and configuration suitable for creating an air jet A capable of stably supporting a sports ball 101 above the sleeve 80. The sleeve 80 is constructed from a supple material, such as a woven or nonwoven fabric or plastic film, whereby the sleeve 80 collapses under the force of gravity in the absence of an inflating supply of pressurized air from the fan 40.

The limp nature of the sleeve 80 allows the inflated sleeve 80 to bend and flex when struck with a striking instrument 102, such as a baseball bat 102*a* or tennis racket 102*b*, thereby allowing the striking instrument 102 to "pass through" the sleeve 80 (actually allowing the sleeve 80 to bend underneath the striking instrument 102) without toppling the tee 10, sending vibratory shock waves through the striking instrument 102 to the user (not shown) or damaging the tee 10 or the striking instrument 102.

Referring to FIGS. 4*a-c* and 5*a-c*, the tee 10 can conveniently be packaged as a kit, with several sleeves 80 of varying longitudinal length such as a short sleeve 80*a*, an intermediate length sleeve 80*b* and a long sleeve 80*c* to accommodate users (not shown) of different height, and/or sleeves 80 with differently sized, shaped and/or configured nozzles 89 such as a single small nozzle 89*a*, a single large nozzle 89*b* or several circumferentially spaced nozzles 89*c* to accommodate sports balls 101 of different size and weight. Replacement or customization sleeves 80 can also be provided as an ancillary product to permit a user to customize or personalize the tee 10, with a nearly endless supply of customization options available from a hot pink sleeve 80 with sequins attached to the surface, to a sleeve 80 depicting the black and grey stripes of a prison uniform.

The kit can also include one or more sports balls 101 and/or associated striking instruments 102.

Figure 6B:
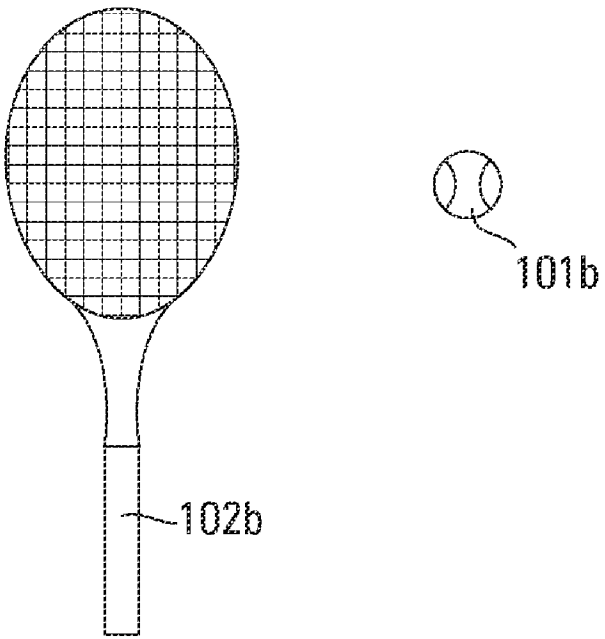
FIG. 6*b* is a side view of a tennis racquet and tennis ball.
Figure 6A:
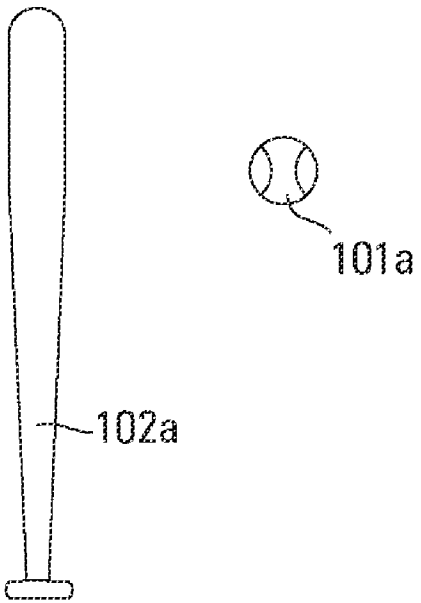
FIG. 6*a* is a side view of a baseball bat and ball.

The tee 10 can be used to practice the striking of substantially any sports ball 101 normally struck with a striking device 102, two of which are depicted in FIGS. 6*a* and 6*b* and others listed in the attached Table A.

| SPORT | BALL | STRIKING INSTRUMENT |
|---|---|---|
| Baseball | Baseball (101a) | Baseball Bat (102a) |
| Softball | Softball | Softball Bat |
| Wiffleball | Wiffleball Ball | Bat |
| Tennis | Tennis Ball (101b) | Tennis Racquet (102b) |
| Table Tennis | Ping-Pong Ball | Ping Pong Paddle |
| Racquetball | Racquetball Ball | Racquetball Racquet |
| Cricket | Cricket Ball | Cricket Bat |
| Handball | Handball Ball | Hand |
| Golf | Golf Ball | Golf Club |

Use

A user (not shown) (i) places the tee 10 upon a relatively flat horizontal surface H, (ii) optionally replaces the sleeve 80 attached to the housing 30 with a different sleeve 80 suited to the user's height, taste, and/or the type of sports ball 101 to be supported by the tee 10, (iii) turns on the fan 40 by "flipping" the ON/OFF switch 51 to ON, (iv) places a sports ball 101 atop the nozzle 89 on the inflated sleeve 80, (v) releases the sports ball 102 so that the air jet A emanating from the nozzle 89 may lift and support the sports ball 101 above the sleeve 80, (vi) strikes the supported sports ball 101 with a suitable striking instrument 102, and (vii) repeats steps (iv) through (vi) as desired.

I claim:

1. A method of practicing the striking of a sports ball with a striking instrument, comprising:

(a) obtaining a pneumatic practice tee, including at least:

(i) a base for supporting the practice tee upon a horizontal surface, (ii) a housing supported by the base with an air inlet and an air outlet, (iii) a fan within the housing for producing an air current, the fan and housing configured and arranged for directing an air current generated by the fan through the outlet, and (iv) an inflatable sleeve in releasable fluid communication with the air outlet at a proximal longitudinal end and having a nozzle at a longitudinal distal end wherein the sleeve is inflated only when and for so long as the fan is operated to generate a current of air, (b) placing the pneumatic practice tee upright upon a horizontal support surface, (c) activating the fan to inflate the sleeve and generate an air jet exiting the pneumatic practice tee through the nozzle, (d) placing a sports ball within the air jet, whereby the sports ball is supported a distance above the nozzle by the air jet, (e) striking the sports ball supported by the air jet with a striking instrument.

2. The method of claim 1 further comprising the step of replacing the inflatable sleeve in fluid communication with the air outlet with another inflatable sleeve having a different longitudinal length.

3. The method of claim 1 wherein the striking instrument is a bat.

4. The method of claim 1 wherein the striking instrument is a racquet.

* * * * *